US005361945A

United States Patent [19]

Johanson

[11] Patent Number: 5,361,945

[45] Date of Patent: Nov. 8, 1994

[54] COMBINATION HOPPER

[75] Inventor: Jerry R. Johanson, San Luis Obispo, Calif.

[73] Assignees: J R Johanson, Inc., San Luis Obispo, Calif.;

[21] Appl. No.: 55,672

[22] Filed: Apr. 29, 1993

[51] Int. Cl.[5] ..... B67C 11/00

[52] U.S. Cl. ..... 222/145; 222/460; 222/462; 222/572; 220/608

[58] Field of Search ..... 222/460, 461, 462, 575, 222/181, 185, 564, 145, 572; 220/608, 669, 674, 675, DIG. 13; 141/297, 331

[56] References Cited

U.S. PATENT DOCUMENTS 4,682,950 7/1987 Dragan ..... 222/575 X 4,958,741 9/1990 Johanson ..... 222/460

*Primary Examiner*—Andres Kashnikow

*Assistant Examiner*—Anthoula Pomrening

*Attorney, Agent, or Firm*—Daniel C. McKown

[57] ABSTRACT

A versatile one-dimensional hopper is described as well as structures that result when the one-dimensional hopper is integrated with a conical bin and when the one-dimensional hopper is integrated with a V-blender. In combining the one-dimensional hopper with other structures, the diameter of the outlet is first specified, and then the slopes of the load-bearing surfaces are chosen to achieve specified flow characteristics. The load-bearing surfaces are then extended obliquely upward until, at some height their maximum dimension measured horizontally equals a value determined by the structure to which the one-dimensional hopper is to be attached. Where the surface of the bin or other structure is higher than this height, vertical surfaces that extend upwardly from the periphery of the one-dimensional hopper are provided for the purpose of connecting the one-dimensional hopper to the structure above it.

12 Claims, 4 Drawing Sheets

COMBINATION HOPPER

BACKGROUND OF THE INVENTION

1. Field of the Invention

The present invention is in the field of hoppers for use with solid particulate materials, such as grain. More specifically, there is described a hopper that is a combination of a conical hopper and a one-dimensional hopper. The combination hopper prevents rat-holing of the material and bin hangups, while conserving on the vertical headroom required to accommodate the combination hopper.

2. The Prior Art

In U.S. Pat. No. 4,958,741 issued Sep. 25, 1990 to the present inventor, there is described a bin module that includes a first section that diverges upwardly from a circular outlet to an oval-shaped upper edge. In the invention of U.S. Pat. No. 4,958,741, this first section is joined end-to-end to a second section that provides a transition from an oval to a circular shape. This arrangement differs from the arrangements described herein in two significant ways.

First, in U.S. Pat. No. 4,958,741 the sections are joined end-to-end. In contrast, in the present invention, the sections are physically integrated, resulting in reduced height.

Second, in U.S. Pat. No. 4,958,741 the upper section has a specific shape, which is different from the shapes used in the present invention for the upper section. In this way, the present invention is seen to extend the earlier work to new ground; i.e., to shapes that were previously thought to be intractable.

Several considerations drive the design of hoppers. First, it is important that the material not form a bridge or arch within the hopper, because such an arch interferes or terminates the flow of material from the bottom of the hopper. If and when the arch collapses, the material may surge from the hopper. It is well known that arching can be eliminated if the opening at the bottom of the hopper is large enough.

A second consideration in the design of hoppers is that the wall of the hopper must be steep enough so that the material will slide smoothly along the wall during discharge. If the wall is not steep enough, a thick layer of material will cling to the wall and discharge will take place from only a limited region near the axis of the hopper, a condition referred to as "rat-holing." For a hopper having the shape of a section of a right circular cone, the largest semi-apex angle at which mass flow will occur, for a particular material is known as the mass flow angle for that particular material.

The present invention is responsive to both of these considerations and results in a combined hopper that eliminates both arching and rat-holing.

SUMMARY OF THE INVENTION

In accordance with the present invention, the limitations of the simple conical hopper are overcome by integrating a one-dimensional hopper into the conical hopper. The conical and one-dimensional hoppers are not merely combined in succession, but instead are physically integrated into a single hopper of complex shape.

Three embodiments of the combination hopper will be described below, and the concept will be applied to the design of a V-blender.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 3:
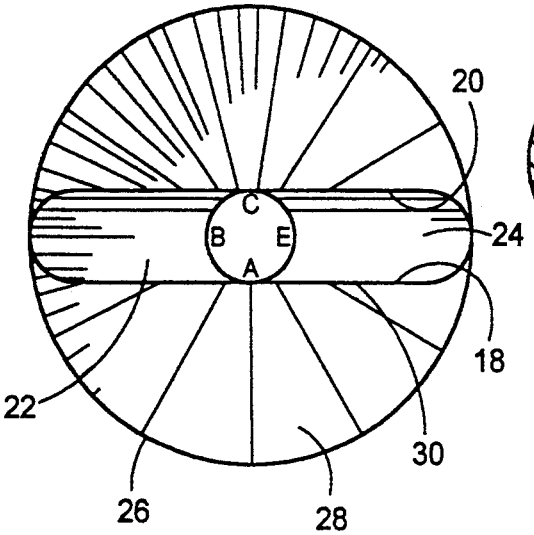
FIG. 3 is a top plan view of the combination hopper of FIG. 1.
Figure 4:
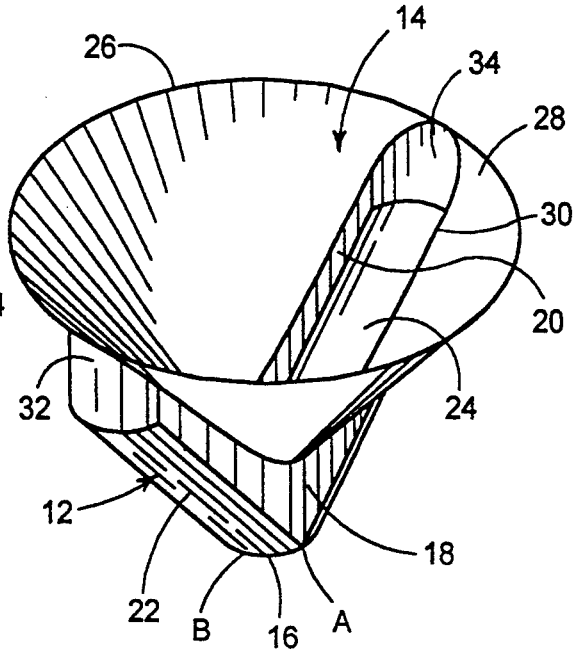
FIG. 4 is a perspective view of the combined hopper of FIG. 1.
Figure 1:
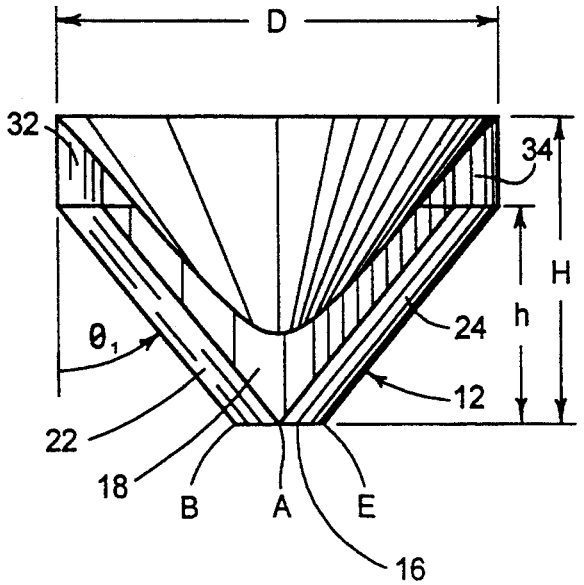
FIG. 1 is a front elevational view showing a first preferred embodiment of the combination hopper.
Figure 2:
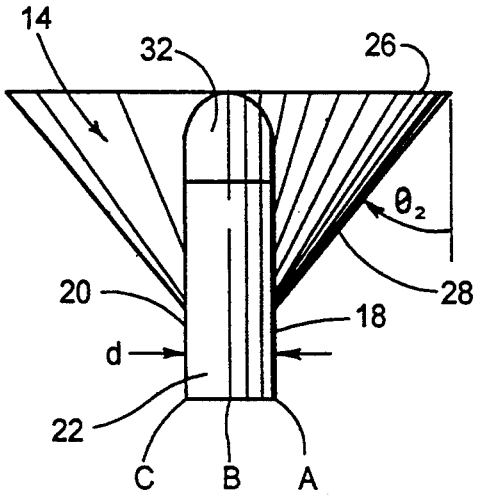
FIG. 2 is a side elevational view of the combination hopper of FIG. 1.
Figure 7:
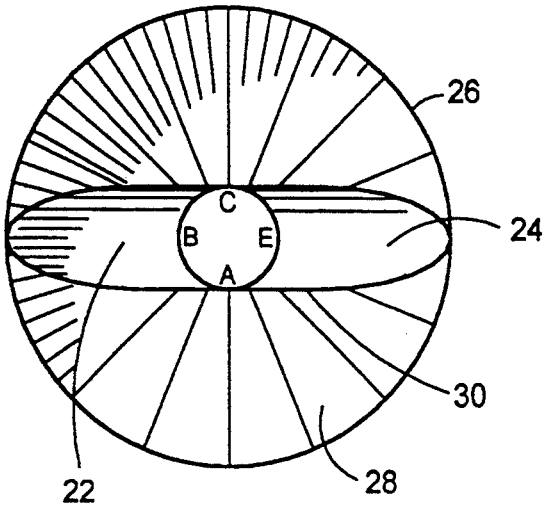
FIG. 7 is a top plan view of the combination hopper of FIG. 5.
Figure 8:
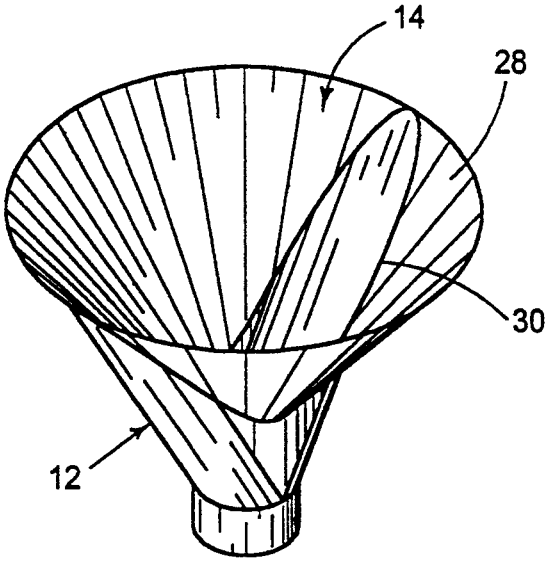
FIG. 8 is a perspective view of the combination hopper of FIG. 5.
Figure 5:
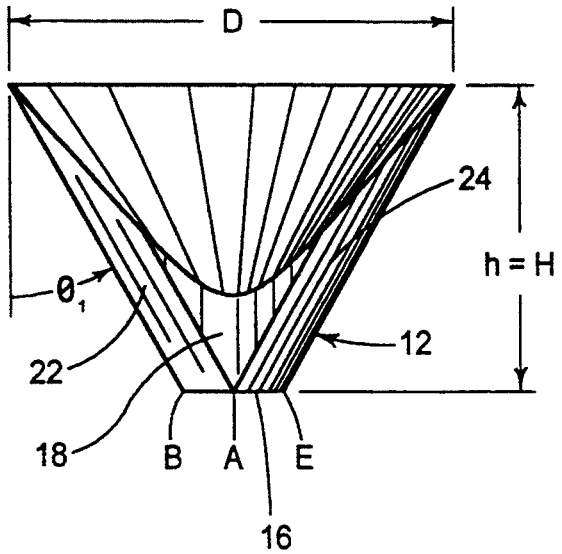
FIG. 5 is a front elevational view showing a second preferred embodiment of the combination hopper.
Figure 6:
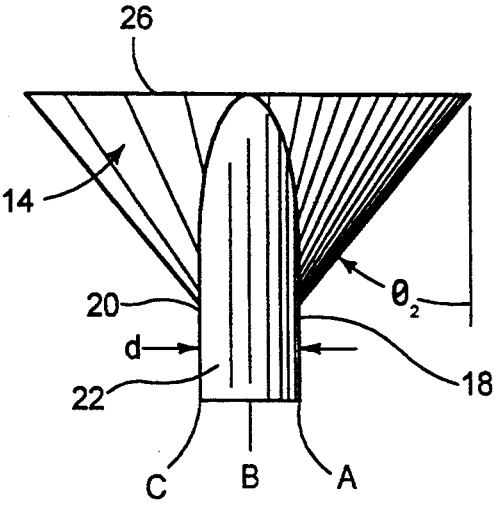
FIG. 6 is a side elevational view of the combination hopper of FIG. 5.
Figure 11:
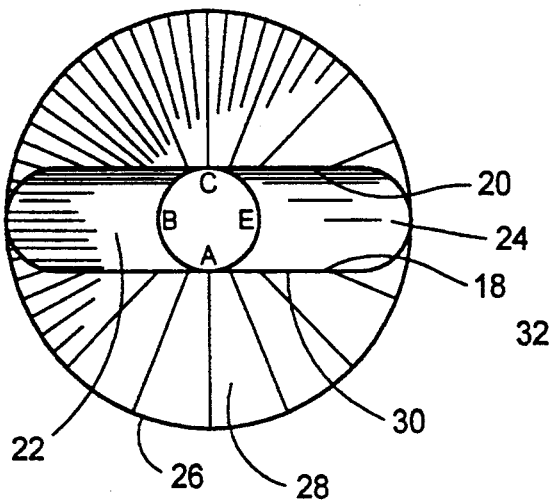
FIG. 11 is a top plan view of the combination hopper of FIG. 9.
Figure 12:
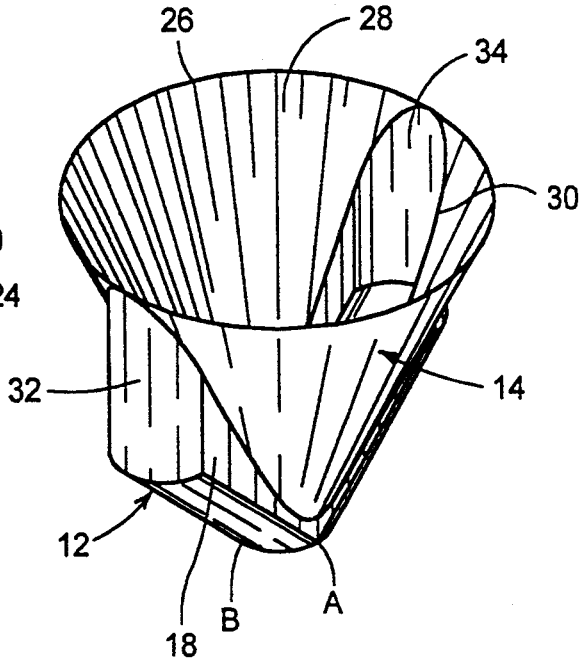
FIG. 12 is a perspective view of the combined hopper of FIG. 9.
Figure 9:
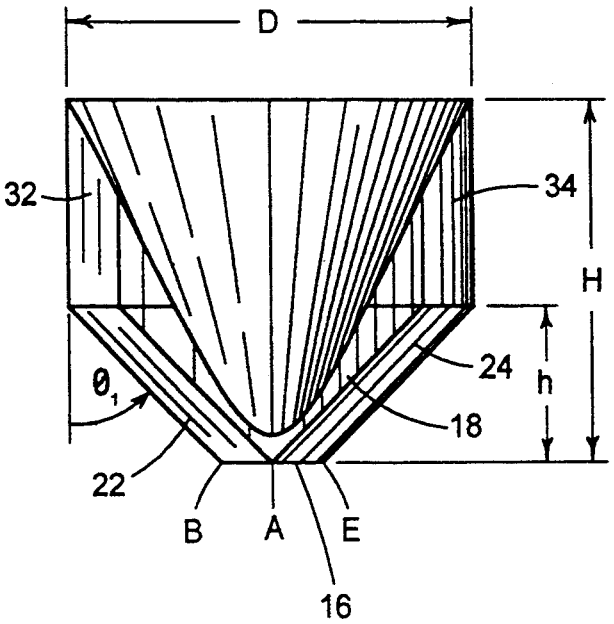
FIG. 9 is a front elevational view showing a third preferred embodiment of the combination hopper of the present invention.
Figure 10:
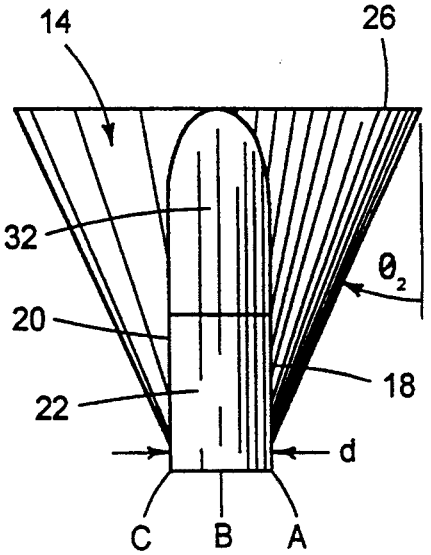
FIG. 10 is a side elevational view of the combined hopper of FIG. 9.
Figure 15:
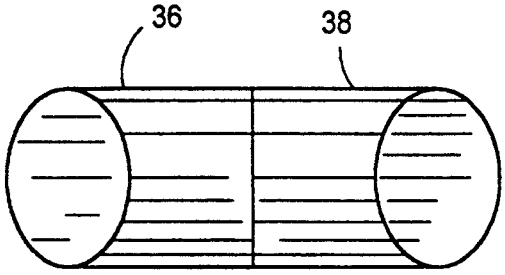
FIG. 15 is a top plan view of the V-blender of FIG. 13.
Figure 16:
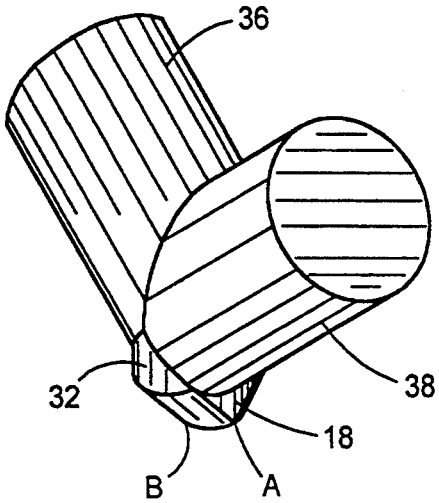
FIG. 16 is a perspective view of the V-blender of FIG. 13.
Figure 13:
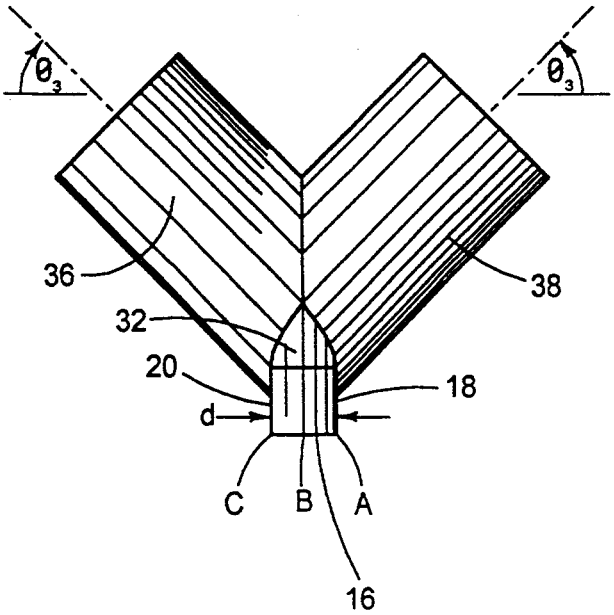
FIG. 13 is a side elevational view of a V-blender employing the principles of the present invention.
Figure 14:
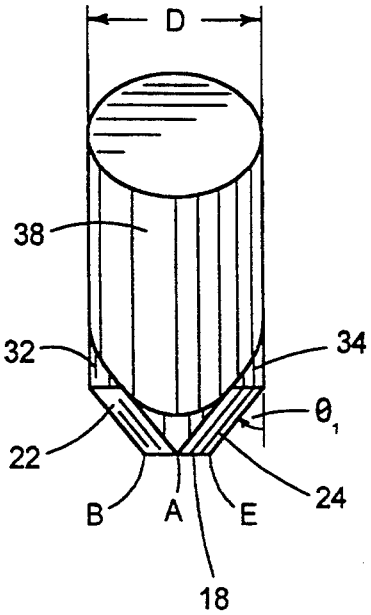
FIG. 14 is a front elevational view of the V-blender of FIG. 13.

In the first preferred embodiment shown in FIGS. 1–4, the combination hopper includes a one-dimensional hopper 12 that is surmounted by a conical hopper 14. The one-dimensional hopper 12 includes an outlet 16 at its lower end for discharging the particulate material. Although the outlet 16 would usually be circular as shown in FIGS. 1–4, in alternative embodiments, the shape of the outlet may be rectangular or rhombic. As an aid to establishing directions, it is helpful to consider that the points A, B, C and E are spaced 90 degrees apart around the outlet, so that A is opposite C and B is opposite E, as best seen in FIG. 3. These points are also shown in FIGS. 1, 2 and 4.

The points A and C are spaced a distance d apart. Through the points A and C pass planar vertical surfaces 18 and 20, respectively.

Load-bearing surfaces 22 and 24 are confined between the planes 18 and 20, and the load-bearing surfaces 22 and 24 diverge upwardly from the opposing points B and E at angles $\theta_1$ with respect to the vertical. As best seen in FIG. 1, the load-bearing surfaces continue to diverge upwardly until, at a height h above the outlet 16, they reach a maximum dimension, measured in a horizontal plane, equal to D, the diameter of the conical hopper 14.

The load-bearing surfaces have a downwardly arched shape in the preferred embodiment, but in other embodiments, the cross section of the load-bearing surfaces may be flat or V-shaped.

In accordance with the present invention, the conical hopper 14 includes a circular top 26 that is located at a height H not less than the height h of the one-dimensional hopper 12. The circular top 26 is concentric with the outlet 16 when viewed from above, as in FIG. 3.

The conical surface 28 of the conical hopper 14 converges downwardly from the circular top 26 at a semi-apex angle $\theta_2$.

The conical surface 28 includes an aperture 30, seen in FIGS. 3 and 4, that is formed by the upward projection of the one-dimensional hopper 12. In this way, the planar vertical surfaces 18 and 20 of the one-dimensional hopper 12 are connected to the conical surface 28 of the conical hopper, with no part of the one-dimensional hopper extending above the conical surface 28. In general, there will be regions where the height of the conical surface 28 exceeds the height h of the one-dimensional hopper, notably at the outer ends of the load-bearing surfaces 22 and 24. In such areas where the conical surface exceeds the height h of the one-dimensional hopper, vertical surfaces 32 and 34 are provided to complete the integrity of the combination hopper.

In the preferred embodiment, the vertical surfaces 32 and 34 have a semi-circular cross section when viewed from above as in FIG. 3, but in alternative embodiments, the vertical surfaces 32 and 34 may have other shapes. In the embodiment of FIGS. 5–8, h equals H, and accordingly, the vertical surfaces are eliminated.

The embodiment of FIGS. 5–8 is a special case of the more general embodiment of FIGS. 1–4. For convenience, like parts are denoted by the same reference numerals throughout the several embodiments.

In the embodiment of FIGS. 9–12, the angle $\theta_2$ is smaller than in FIG. 1 thereby making the conical surface 28 steeper, and the angle $\theta_1$ is larger than in FIG. 1, thereby reducing the slope of the load-bearing surfaces 22 and 24.

In the preferred embodiment, the angle $\theta_1$ will be chosen so that the particulate material will flow along the load-bearing surfaces 22 and 24 when the hopper is full. This condition is not necessary in all embodiments of the invention, and in other embodiments the angle $\theta_1$ could be chosen to render the load-bearing surfaces self-cleaning.

In the preferred embodiment, the angle $\theta_2$ is chosen to render the conical surface 28 to be self-cleaning. In other embodiments of the invention, such a choice is not necessary, since the clean-out of the conical hopper could be assisted by vibrators or air cannons.

In practicing the invention, it has been found that the planar vertical surfaces 18 and 20 must not converge downwardly, and to prevent this from happening through fabrication errors, one might specify a very slight downward divergence.

Upon reflection it will be realized that the one-dimensional hopper 12 described above can be adapted to use with structures other than the conical hopper 14, and in general this is made possible by providing vertical surfaces such as the surfaces 32 and 34 to enclose the spaces between the one-dimensional hopper 12 and the superior structure to which the one-dimensional hopper is to be attached, in accordance with a teaching of the present invention. As an example of the versatility thus achieved by the present invention, FIGS. 13–16 show the manner in which a one-dimensional hopper 12 can advantageously be integrated into V-blender.

As is known in the art, a V-blender includes two downwardly sloping cylindrical bins 36 and 38 that intersect. The design procedure is similar to that employed in the embodiments discussed above. First, the diameter d of the outlet is selected, and the vertical surfaces 18 and 20 are extended upwardly from opposite points on the outlet. Next, the shape and slope of the load-bearing surfaces 22 and 24 are selected, and those surfaces are extended obliquely upward until their maximum dimension equals D the diameter of the cylindrical bins 36 and 38. At this point the height h of the one-dimensional hopper has been determined. Next, the height H above the outlet at which the V-blender reaches the diameter D is selected, and the vertical surfaces 32 and 34 are then extended upward from the top of the one-dimensional hopper to produce the structure shown FIGS. 13–16.

Thus, there has been described a one-dimensional hopper having a design of considerable versatility. The application of this design to form a combination hopper by combining the one-dimensional hopper with a conical hopper has been described as well as the application of the one-dimensional hopper to a V-blender. It should be clear that other applications can be made, and they also are considered within the scope and spirit of the present invention. Thus, the above examples are intended to demonstrate the versatility of the new design, and these examples should not be considered as defining the limits of the present invention.

What is claimed is:

1. A combination hopper for particulate material that prevents rat-holing and bin hangups while conserving headroom, comprising in combination:

a one-dimensional hopper having a lower end and including an outlet at the lower end, said outlet including four points A, B, C and E successively spaced 90 degrees apart around said outlet, a pair of parallel planar vertical surfaces containing the points A and C and spaced a distance d apart, a pair of load-bearing surfaces confined between said pair of parallel planar vertical surfaces, diverging upwardly from the points B and E at angles $\theta_1$ with respect to the vertical, and extending upward until, at a height h above said outlet, the maximum dimension of said one-dimensional hopper in a horizontal plane equals D;

a conical hopper including a circular top of diameter D located at a height H above said outlet greater than the height h of said one-dimensional hopper, and concentric with the outlet of said one-dimensional hopper, a conical surface converging downwardly from said circular top at a semi-apex angle $\theta_2$ with respect to the vertical, said conical surface containing an aperture formed by the upward projection of said one-dimensional hopper;

said one-dimensional hopper joined to the conical surface of said conical hopper with no part of said one-dimensional hopper extending above the conical surface; and, vertical surfaces extending up from said one-dimensional hopper and connecting said one-dimensional hopper to the conical surface of said conical hopper where the height of the conical surface above said outlet exceeds h.

2. The combination hopper of claim 1 wherein $\theta_1$ is small enough to provide downward flow of the particulate material along said pair of load-bearing surfaces under the action of gravity when the combination hopper is full of particulate material.

3. The combination hopper of claim 1 wherein $\theta_2$ is small enough to render said conical hopper self-cleansing.

4. The combination hopper of claim 1 wherein said outlet is circular.

5. A V-blender for particulate material that prevents rat-holing and bin hangups while conserving headroom, comprising in combination:

a one-dimensional hopper having a lower end and including an outlet at the lower end, said outlet including four points A, B, C and E successively spaced 90 degrees apart around said outlet, a pair of parallel planar vertical surfaces containing the points A and C and spaced a distance d apart, a pair of load-bearing surfaces confined between said pair of parallel planar vertical surfaces, diverging upwardly from the points B and E at angles $\theta_1$ with respect to the vertical, and extending upward until, at a height h above said outlet, the maximum dimension of said one-dimensional hopper in a horizontal plane equals D;

a bin including a first hollow cylinder of diameter D having an axis inclined at an angle $\theta_3$ from a line through the points A and C, a second hollow cylinder of diameter D having an axis inclined at an angle $\theta_3$ from a line through the points A and C and extending in a direction opposite said first hollow cylinder, said first hollow cylinder and said second hollow cylinder intersecting each other and intersecting said one-dimensional hopper the axes of said first hollow cylinder and said second hollow cylinder intersecting at a height H above said outlet greater than the height h of said one-dimensional hopper;

said one-dimensional hopper joined to downwardly-facing surfaces of said first hollow cylinder and said second hollow cylinder with no part of said one-dimensional hopper extending above the downwardly-facing surfaces; and, vertical surfaces extending up from said one-dimensional hopper and connecting said one-dimensional hopper to the downwardly-facing surfaces of said first hollow cylinder and said second hollow cylinder where the height of the downwardly-facing surfaces above said outlet exceeds h.

6. The V-blender of claim 5, wherein $\theta_1$ is small enough to provide downward flow of the particulate material along said pair of load-bearing surfaces under the action of gravity when the V-blender is full of particulate material.

7. The V-blender of claim 5 wherein $\theta_3$ is large enough to render the V-blender self-cleansing.

8. The V-blender of claim 5 wherein said outlet is circular.

9. A combination hopper for particulate material that prevents rat-holing and bin hangups while conserving headroom, comprising in combination:

a one-dimensional hopper having a lower end and including an outlet at the lower end, said outlet including four points A, B, C and E successively spaced 90 degrees apart around said outlet, a pair of parallel planar vertical surfaces containing the points A and C and spaced a distance d apart, a pair of load-bearing surfaces confined between said pair of parallel planar vertical surfaces, diverging upwardly from the points B and E at angles $\theta_1$ with respect to the vertical, and extending upward until, at a height h above said outlet, the maximum dimension of said one-dimensional hopper in a horizontal plane equals D;

a conical hopper including a circular top of diameter D located at a height H above said outlet equal to the height h of said one-dimensional hopper, and concentric with the outlet of said one-dimensional hopper, a conical surface converging downwardly from said circular top at a semi-apex angle $\theta_2$ with respect to the vertical, said conical surface containing an aperture formed by the upward projection of said one-dimensional hopper;

said one-dimensional hopper joined to the conical surface of said conical hopper with no part of said one-dimensional hopper extending above the conical surface.

10. The combination hopper of claim 9 wherein $\theta_1$ is small enough to provide downward flow of the particulate material along said pair of load-bearing surfaces under the action of gravity when the combination hopper is full of particulate material.

11. The combination hopper of claim 9 wherein $\theta_2$ is small enough to render said conical hopper self-cleansing.

12. The combination hopper of claim 9 wherein said outlet is circular.

* * * * *